US008215761B2

(12) United States Patent
Takezawa et al.

(10) Patent No.: US 8,215,761 B2
(45) Date of Patent: Jul. 10, 2012

(54) INKJET PRINTER AND PRINTING METHOD USING THE SAME

(75) Inventors: Satoshi Takezawa, Tomi (JP); Tomotaka Furuhata, Tomi (JP); Takayuki Mitsui, Tomi (JP); Yuko Hishida, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 41 days.

(21) Appl. No.: 12/792,737

(22) Filed: Jun. 3, 2010

(65) Prior Publication Data

US 2010/0289860 A1 Nov. 18, 2010

Related U.S. Application Data

(63) Continuation of application No. PCT/JP2009/005018, filed on Sep. 30, 2009.

(30) Foreign Application Priority Data

Oct. 1, 2008 (JP) ..... 2008-255977

(51) Int. Cl.
*B41J 2/01* (2006.01)

(52) U.S. Cl. ..... 347/102; 347/101

(58) Field of Classification Search ..... 219/216; 346/25; 399/320–342
See application file for complete search history.

(56) References Cited

U.S. PATENT DOCUMENTS

| | | | | |
|---|---|---|---|---|
| 5,864,354 | A * | 1/1999 | Hibino et al. | 347/212 |
| 7,182,453 | B2 * | 2/2007 | Nakajima | 347/102 |
| 7,497,553 | B2 * | 3/2009 | Hoshino | 347/41 |
| 7,766,473 | B2 * | 8/2010 | Hoshino | 347/102 |
| 7,837,319 | B2 * | 11/2010 | Rodin et al. | 347/102 |
| 2002/0140794 | A1 * | 10/2002 | Asano et al. | 347/102 |
| 2003/0035037 | A1 * | 2/2003 | Mills et al. | 347/102 |
| 2005/0168555 | A1 * | 8/2005 | Niekawa | 347/102 |
| 2008/0238983 | A1 * | 10/2008 | Takahashi | 347/23 |

FOREIGN PATENT DOCUMENTS

| | | | |
|---|---|---|---|
| JP | 2004-009483 | | 1/2004 |
| JP | 2004001328 | A * | 1/2004 |
| JP | 2004202864 | A * | 7/2004 |
| JP | 2004-276584 | | 10/2004 |
| JP | 2005-169950 | | 6/2005 |

OTHER PUBLICATIONS

International Search Report for International Application No. PCT/JP2009/005018, Date of mailing: Oct. 27, 2009.

* cited by examiner

*Primary Examiner* — Stephen Meier
*Assistant Examiner* — Leonard S Liang
(74) *Attorney, Agent, or Firm* — Ditthavong Mori & Steiner, P.C.

(57) ABSTRACT

An ink jet printer includes a medium supporter to support a print medium. A print head is configured to eject ink droplets toward the print medium. An ultraviolet light irradiation device is configured to irradiate the print medium with ultraviolet light to cure ink deposited on the print medium. On a carriage, the print head and the ultraviolet light irradiation device are mounted to face the medium supporter. The carriage is reciprocally movable relative to the print medium in a first direction and movable relative to the print medium in a second direction perpendicular to the first direction. The ultraviolet light irradiation device is arranged on a side in the first direction of the print head. The print head is arranged to project toward an upstream side of a feeding direction in the second direction by a predetermined length relative to the ultraviolet light irradiation device.

14 Claims, 10 Drawing Sheets

BACKGROUND ART

INKJET PRINTER AND PRINTING METHOD USING THE SAME

CROSS-REFERENCE TO RELATED APPLICATIONS

The present application is a continuation application of International Application No. PCT/JP2009/005018, filed Sep. 30, 2009, which claims priority to Japanese Patent Application No. 2008-255977, filed Oct. 1, 2008. The contents of these applications are incorporated herein by reference in their entirety.

BACKGROUND OF THE INVENTION

1. Technical Field

The present invention relates to an inkjet printer and a printing method using the inkjet printer.

2. Background Art

Conventionally, there is known an inkjet printer in which ink is ejected from a print head onto a print medium put on a platen while reciprocating the print head in a right-left direction so as to print the print medium. As one of such inkjet printers, there is a printer of a type ejecting ultraviolet curable ink (hereinafter, referred to as UV ink) having a property that it is cured when irradiated with ultraviolet light. Since the UV ink has excellent weather resistance and excellent water resistance, the UV ink allows printed matters to be used as outdoor advertising posters or the like. Therefore, the UV ink has the advantage that the use of printed matters printed with UV ink dramatically increases the range of purposes as compared to printed matters printed with water-soluble ink. Generally, such an inkjet printer of a type ejecting UV ink is provided with an ultraviolet light irradiation device for curing the UV ink deposited on a print medium. In recent years, an inkjet printer has been developed in which an ultraviolet light emitting diode (hereinafter, referred to as UVLED) is used as a light source for emitting ultraviolet light in the ultraviolet light irradiation device.

As an example of the conventional print unit, a print unit 500 is shown in FIG. 10A. For convenience of explanation, directions indicated by arrows shown in FIG. 10A will be defined as forward, backward, leftward, and rightward directions, respectively in the following description. The print unit 500 includes mainly a print head 510 which ejects UV ink, a right ultraviolet light irradiation device 520R, a left ultraviolet light irradiation device 520L, and a carriage (not shown) on which these are disposed. Inside the right ultraviolet light irradiation device 520R and the left ultraviolet light irradiation device 520L, UVLEDs are arranged so as to radiate ultraviolet light downwardly and are disposed and fixed on the right and left sides of the print head 510. The right ultraviolet light irradiation device 520R and the left ultraviolet light irradiation device 520L are designed to have a width in the front-back direction which is substantially the same as the width in the front-back direction of the print head 510. The print head 510 includes, for example, print heads for respective colors (not shown) such as a magenta print head, an yellow print head, a cyan print head, and a black print head.

To conduct printing on a printing line 508 of the print medium 501 by using the aforementioned print unit 500, UV ink droplets are ejected from the respective nozzles of the print heads for respective colors so that the UV ink droplets are superposed in predetermined patterns on a printing line 508 while reciprocating the print unit 500 above the printing line 508 a predetermined number of passes. During this, the right ultraviolet light irradiation device 520R and the left ultraviolet light irradiation device 520L emit ultraviolet light. The printing line 508 is irradiated with the ultraviolet light so as to cure the UV ink deposited on the printing line 508.

FIGS. 10B, 10C are sectional views showing states that LTV ink droplets ejected from the print head 510 are deposited on the printing line 508 as mentioned above. FIG. 10B shows a state that uncured UV ink droplets 512 are ejected and deposited at the current pass on completely cured UV ink droplets 511, which were ejected and deposited at the last pass on the printing line 508 and which were irradiated with ultraviolet light and thus completely cured. Since the UV ink droplets 511 are completely cured, the affinity of the uncured UV ink droplets 512 for the completely cured UV ink 511 are poor so that the uncured UV ink droplets 512 are deposited in a raised shape like beading because of surface tension. After the uncured UV ink droplets 512 are deposited in a beading state, the uncured UV ink droplets 512 spread very little before irradiation with ultraviolet light because of poor affinity and is then completely cured in this state by irradiation with ultraviolet light.

On the other hand, FIG. 10C shows a state that uncured UV ink droplets 514 are ejected and deposited at the current pass on uncured UV ink droplets 513, which were ejected and deposited at the last pass on the printing line 508 and which were not cured (or cured very little). The affinity of the later uncured UV ink droplets 514 for the prior uncured UV ink droplets 513 are good so that, after the later uncured UV ink droplets 514 are deposited in a beading state, the later uncured UV ink droplets 514 are mixed with the prior uncured UV ink droplets 513 and thus bleed. The later uncured UV ink droplets 514 and the prior uncured UV ink droplets 513 are mixed so as to form a mixed UV ink 515. The mixed UV ink 515 is irradiated with ultraviolet light and is thus completely cured. To prevent UV ink from bleeding as mentioned above, for example, JP-A-2004-276584 discloses an arrangement in which, after the surfaces of ink droplets deposited on a recording medium 2 are cured by ultraviolet light emitted from first light irradiation devices 17, 18, 19, and 20, the ink droplets are completely cured by ultraviolet light emitted from a second light irradiation device 21.

By the way, for printing on the print medium 501 by the print unit 500, it is preferable that UV ink droplets deposited and superposed on the print medium 501 are not mixed and thus do not bleed, but the UV ink droplets spread and are thus leveled. In this case, the print medium 501 with desired printing (desired printed matter) can be obtained. However, when the uncured UV ink droplets 512 are superposed on and adhere to the completely cured UV ink droplets 511 as shown in FIG. 10B, the completely cured UV ink droplets 511 and the uncured UV ink droplets 512 are not mixed and thus do not bleed, but the completely cured UV ink droplets 511 reject the uncured UV ink droplets 512 so that the uncured UV ink droplets 512 may be cured by irradiation with ultraviolet light in the state remaining a raised shape like beading on the surface of the completely cured UV ink droplets 511. As compared to the desired printed matter, the printed matter in which UV ink droplets are cured in the state remaining the beading shape may have poorer print quality because reflection of light from the printed matter may differ so as to cause difference in vision.

When the later uncured UV ink droplets 514 are superposed on and adhere to the prior uncured UV ink droplets 513 as shown in FIG. 10C, the later uncured UV ink droplets 514 may be mixed with the prior uncured UV ink droplets 513 and thus bleed so that the UV ink droplets may be cured by irradiation with ultraviolet light in the mixed and bleeding state. As compared to the desired printed matter, the printed matter in which UV ink droplets are cured in the mixed and bleeding state may have poorer print quality because a mixed and bleeding portion of the printed matter has different color in vision.

SUMMARY OF THE INVENTION

According to one aspect of the present invention, an ink jet printer includes a medium supporter, a print head, an ultraviolet light irradiation device, and a carriage. The medium supporter supports a print medium. The print head is configured to eject ink droplets toward the print medium supported by the medium supporter. The ultraviolet light irradiation device is configured to irradiate the print medium with ultraviolet light to cure ink deposited on the print medium. On the carriage, the print head and the ultraviolet light irradiation device are mounted to face the medium supporter. The carriage is reciprocally movable relative to the print medium in a first direction and movable relative to the print medium in a second direction perpendicular to the first direction. The ultraviolet light irradiation device is arranged on a side in the first direction of the print head. The print head is arranged to project toward an upstream side of a feeding direction in the second direction by a predetermined length relative to the ultraviolet light irradiation device.

According to another aspect of the present invention, a printing method includes providing an inkjet printer. The ink jet printer includes a medium supporter, a print head, an ultraviolet light irradiation device, and a carriage. The medium supporter supports a print medium. The print head is configured to eject ink droplets toward the print medium supported by the medium supporter. The ultraviolet light irradiation device is configured to irradiate the print medium with ultraviolet light to cure ink deposited on the print medium. On the carriage, the print head and the ultraviolet light irradiation device are mounted to face the medium supporter. The carriage is reciprocally movable relative to the print medium in a first direction and movable relative to the print medium in a second direction perpendicular to the first direction. The ultraviolet light irradiation device is arranged on a side in the first direction of the print head. The print head is arranged to project toward an upstream side of a feeding direction in the second direction by a predetermined length relative to the ultraviolet light irradiation device. A first ink droplet is ejected toward the print medium from a portion of the print head projecting toward the upstream side of the feeding direction in the second direction relative to the ultraviolet light irradiation device, while moving the carriage relative to the print medium in the first direction. The carriage is moved relative to the print medium in the second direction to, while moving the carriage in the first direction, eject a second ink droplet from a portion of the print head on a side in the first direction where the ultraviolet light irradiation device is positioned such that the second ink droplet is superposed on the first ink droplet. The first and second ink droplets are irradiated with ultraviolet light from the ultraviolet light irradiation device to cure the first and second ink droplets.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 5A-5B are schematic illustrations for explaining a printing method by four passes, wherein FIG. 5A shows a state of the first pass and FIG. 5B shows a state of the second pass;

FIGS. 6A-6B are schematic illustrations for explaining a printing method by four passes, wherein FIG. 6A shows a state of the third pass and FIG. 6B shows a state of the fourth pass;

DESCRIPTION OF THE EMBODIMENTS

Hereinafter, embodiments of the present invention will be described with reference to attached drawings by means of first through fifth embodiments as examples. Each of the first through fifth embodiments as will be described below illustrates an arrangement in which printing is conducted by four passes (by superposing UV ink droplets four times). For convenience of explanation, in each figure, directions indicated by arrows will be defined as forward, backward, leftward, rightward, upward, and downward directions, respectively in the following description.

First Embodiment

Figure 1:
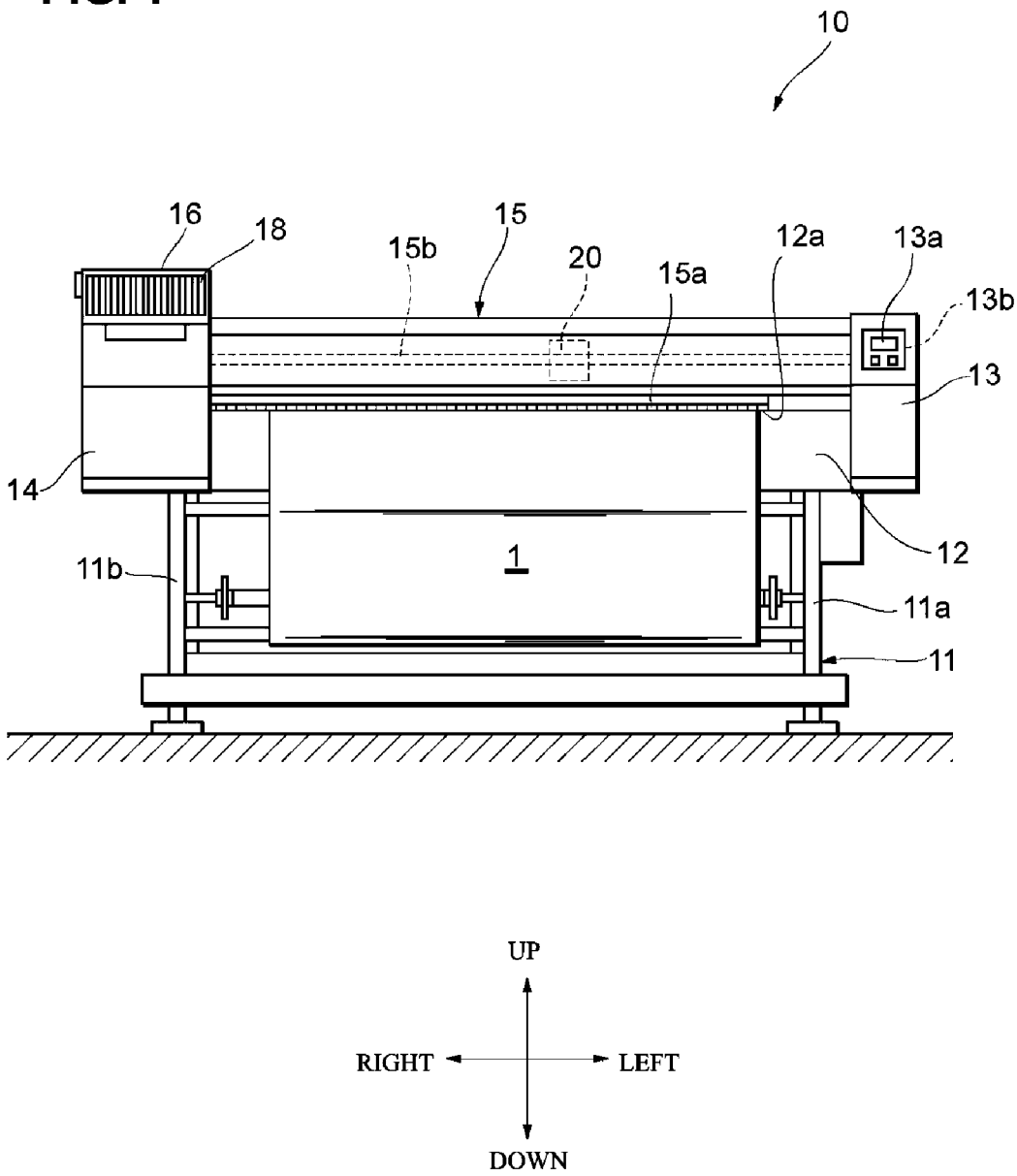
FIG. 1 is a front view showing an inkjet printer according to an embodiment of the present invention.
Figure 2:
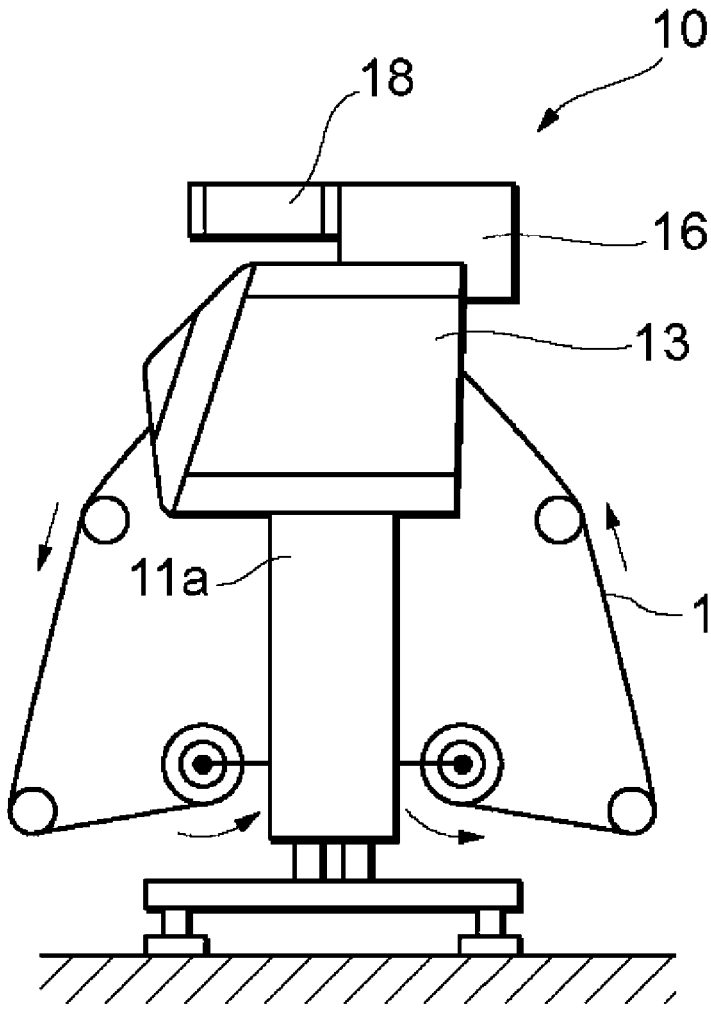
FIG. 2 is a side view of the inkjet printer according to the embodiment of the present invention.
Figure 2:
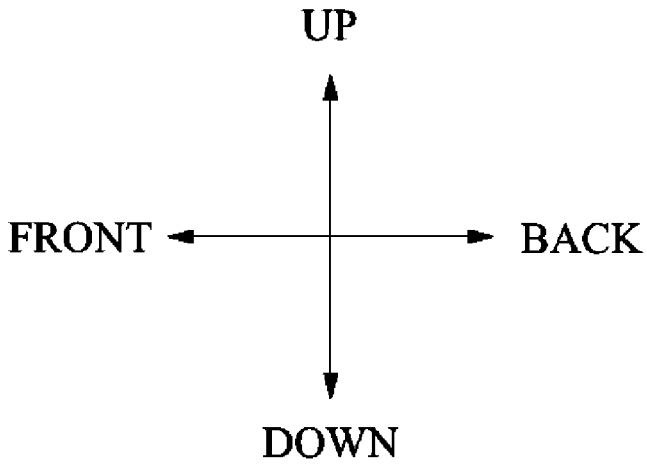
Figure 3:
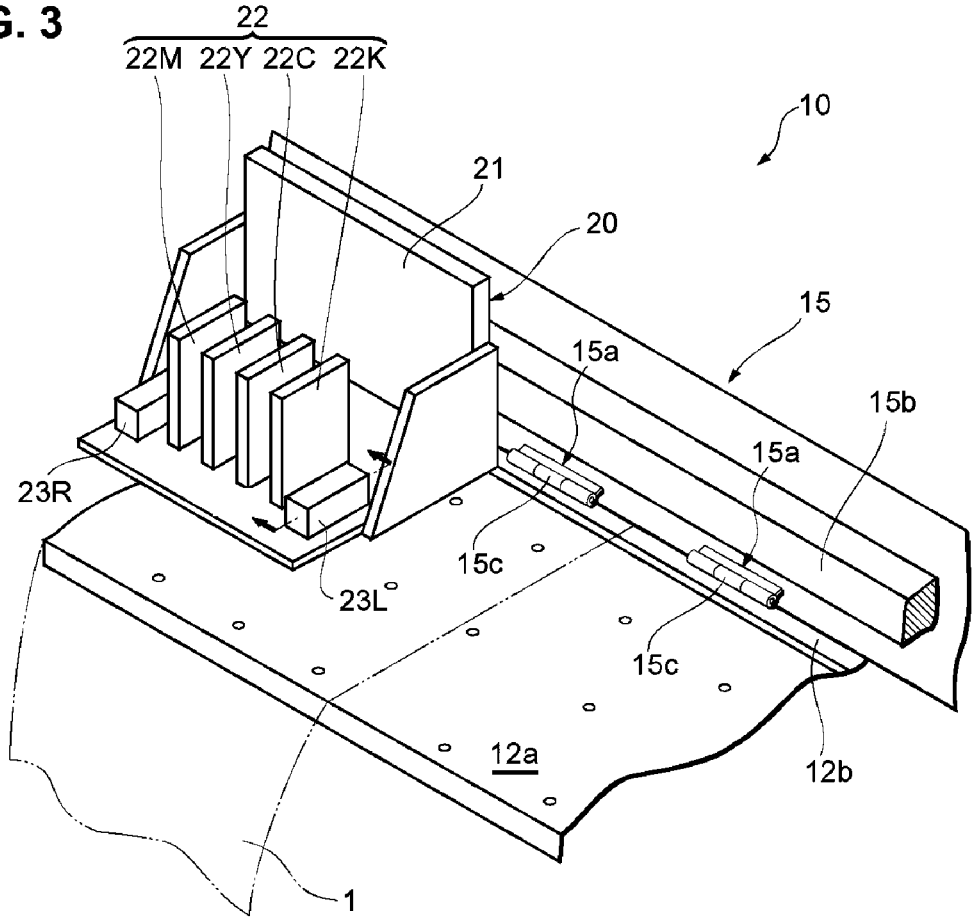
FIG. 3 is a perspective view showing a portion around a print unit.
Figure 3:
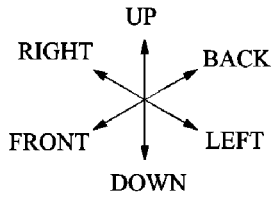

With reference to FIG. 1 through FIG. 3, the entire structure of an inkjet printer 10 as an embodiment of the present invention will be described. FIG. 1 is an illustration of the inkjet printer 10 as seen from the front, FIG. 2 is an illustration of the inkjet printer 10 as seen from the left side, and FIG. 3 is an illustration of a portion around a print unit.

As shown in FIG. 1, the inkjet printer 10 includes a supporting leg section 11 having left and right supporting legs 11*a*, 11*b*, a central body section 12 supported by the supporting leg section 11, a left body section 13 disposed on a left side of the central body section 12, and a right body section 14 disposed on a right side of the central body section 12, and an upper body section 15 which connects the left and right body sections 13, 14 and is disposed above the central body section 12 with some space and extends in parallel with the central body section 12. The central body section 12 is provided with a platen 12*a* which exposed on the upper surface of the central body section 12 and which extends in the right-left direction.

At a lower portion of the upper body section 15, a plurality of clamping devices 15*a* are aligned in the right-left direction (see FIG. 3). Each clamping device 15*a* has a pinch roller 15*c* which is rotatably disposed at the front end of the clamping device 15*a*. Below the pinch roller 15*c*, a cylindrical feeding roller 12*b* extending in the right-left direction is disposed to exposed on the platen 12*a* and is driven to rotate by a roller driving motor (not shown) installed inside the central body section 12. Each clamping device 15*a* can be switched between a clamping position where the pinch roller 15*c* is pressed against the feeding roller 12*b* and an unclamping position where the pinch roller 15*c* is spaced apart from the feeding roller 12*b*. According to this structure, by driving the roller driving motor in a state that the print sheet 1 as a long sheet-like print subject is sandwiched between the pinch rollers 15*c* and the feeding roller 12*b* and the clamping devices 15*a* are set in their clamping positions, the print sheet 1 can be fed forward or backward for a desired distance.

As shown in FIG. 1, an operation panel 13*a* composed of operational switches, a display, and the like is attached to the front surface of the left body section 13 and a controller 13*b* is arranged inside the left body section 13. By this controller 13*b*, operations of respective components (for example, UVLED modules 31 as will be described later) of the inkjet printer 10 are controlled. At an upper portion of the right body section 14, a cartridge mounting portion 16 is disposed to which a plurality of cartridge-type ink tanks 18 for respective colors are detachably attached from the front. As shown in FIG. 3, a guide rail 15*b* extending in the right-left direction is arranged inside the upper body 15. A print unit 20 is installed such that the print unit 20 can be reciprocated in the right-left direction along the guide rail 15*b*.

As shown in FIG. 3, the print unit 20 is mainly composed of a carriage 21, a print head 22, and a left ultraviolet light irradiation device 23L, and a right ultraviolet light irradiation device 23R. The back of the carriage 21 is fitted with the guide rail 15*b* so as to reciprocate along the guide rail 15*b* in the right-left direction. In addition, the carriage 21 functions as a mounting base for the print head 22, the left ultraviolet light irradiation device 23L, and the right ultraviolet light irradiation device 23R. The print head 22 includes, for example, print heads 22M, 22Y, 22C, and 22K for respective colors of magenta (M), yellow (Y), cyan (C), and black (K), which are connected to the aforementioned ink tanks 18 through rubber tubes. Each of the print heads 22M, 22Y, 22C, and 22K has a plurality of nozzle holes (not shown) formed in the lower surface thereof for ejecting UV ink downwardly.

Figure 4A:
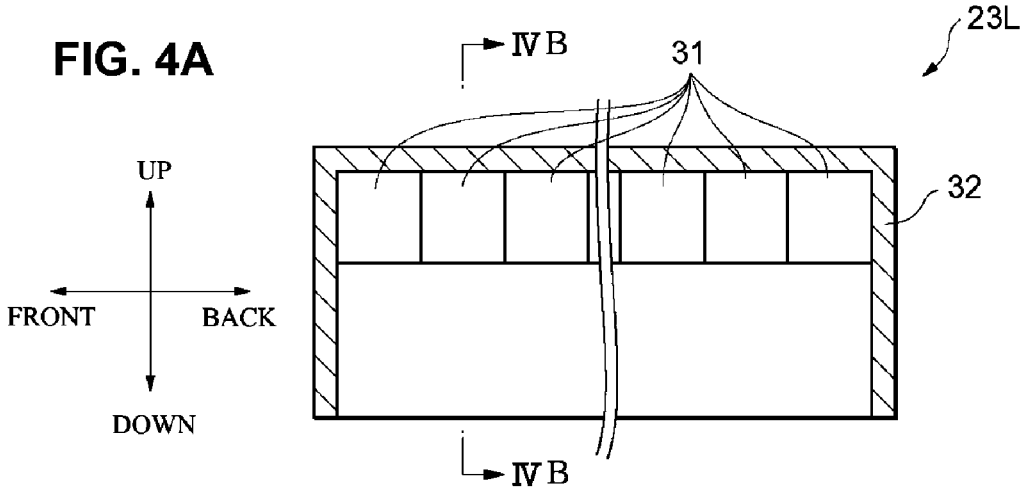
FIG. 4A is a sectional view taken along a line IVA-IVA in FIG. 3
Figure 4B:
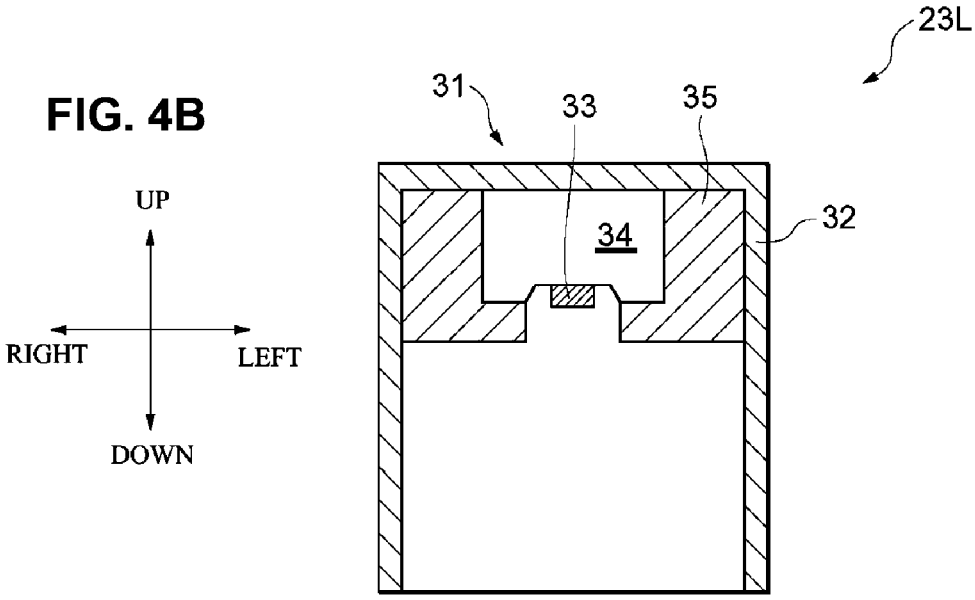
FIG. 4B is a sectional view taken along a line IVB-IVB in FIG. 4A.
Figure 5A:
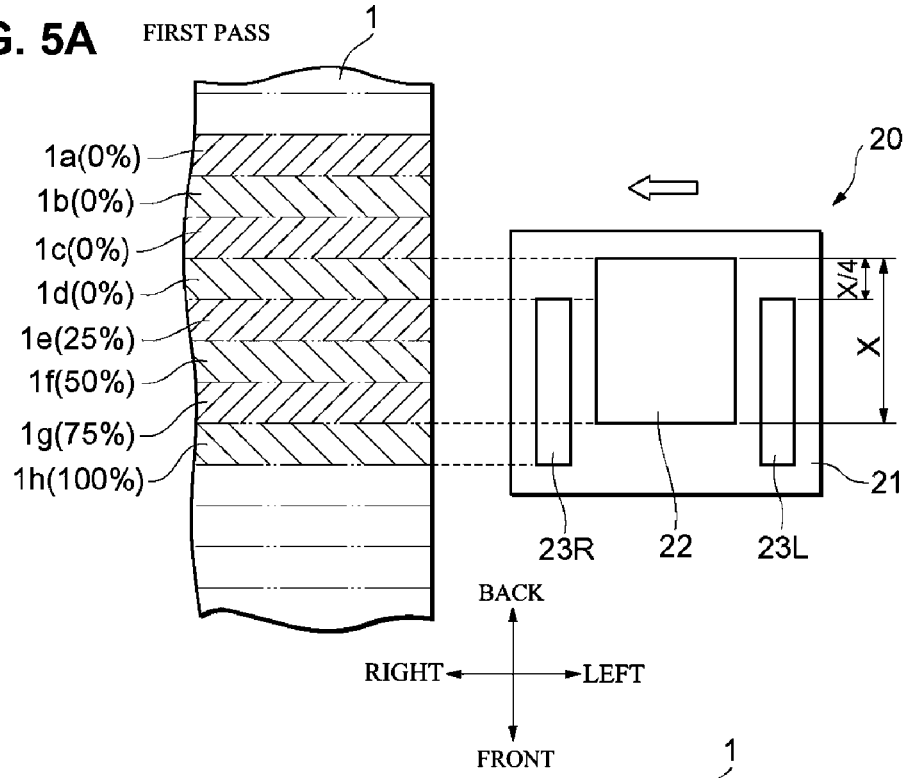
Figure 5B:
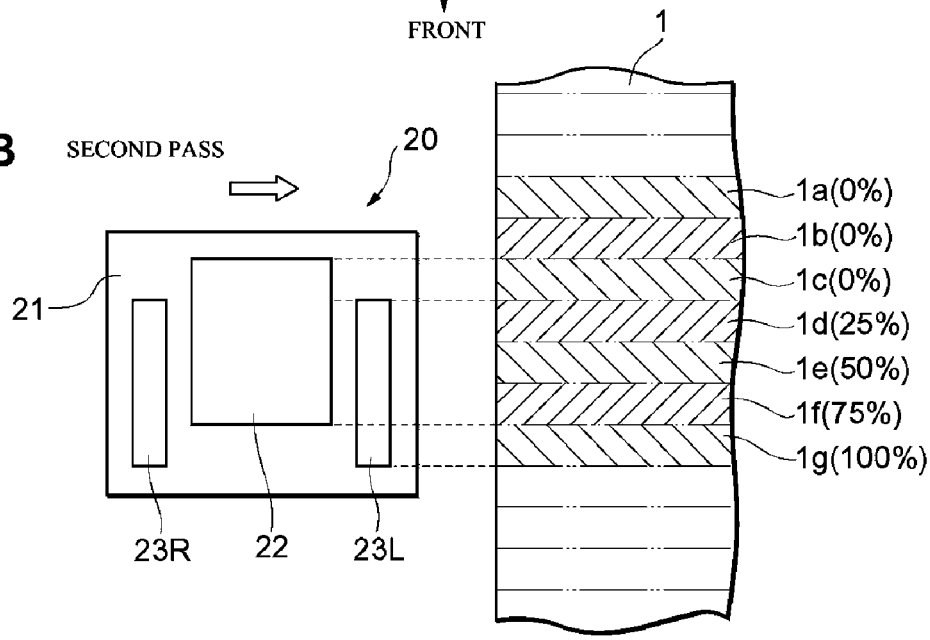

Hereinafter, the left ultraviolet light irradiation device 23L disposed on the left side of the print head 22 (22K) will be described with reference to FIGS. 4A, 4B and FIGS. 5A, 5B in addition to FIG. 1 through FIG. 3. FIG. 4A is a sectional view of a portion IVA-IVA in FIG. 3, FIG. 4B is a sectional view of a portion IVB-IVB in FIG. 4A, FIGS. 5A and 5B are illustrations of the print unit 20 as seen from above, respectively. It should be noted that the right ultraviolet light irradiation device 23R disposed on the right side of the print head 22 (22M) has the same structure as that of the left ultraviolet light irradiation device 23L so that the explanation of the right ultraviolet light irradiation device 23R will be omitted.

As shown in FIG. 4A, the left ultraviolet light irradiation device 23L is mainly composed of, for example, a plurality of UVLED modules 31 which are aligned in the front-back direction and a cover 32 opening downwardly. As shown in FIG. 4B, each UVLED module 31 includes a base portion 34, an UVLED chip 33 capable of emitting ultraviolet light which is fixed to the lower end of the base portion 34 and a module body 35, wherein the base portion 34 is inserted in the module body 35 through the top of the same and is fixed to the module body 35. According to this structure, the print sheet 1 is irradiated with ultraviolet light emitted from the UVLED chips 33. It should be noted that another arrangement may be employed which includes an optical lens (not shown) which is fixed to the module body 35 below the UVLED chips 33 and a sealing resin (not shown) filled in a range surrounded by the base portion 34, the module body 35, and the optical lens. In this case, ultraviolet light emitted from the UVLED chip 33 is radiated downwardly at a predetermined radiation angle through the optical lens. Though the UVLED modules 31 are aligned in the front-back direction in the aforementioned example, the UVLED modules 31 may be set on a plain in the front-back direction and the right-left direction.

As shown in FIG. 5A, the width in the front-back direction of the left ultraviolet light irradiation device 23L is substantially the same as the width X in the front-back direction of the print head 22. In case of printing by four passes, the print head 22 is mounted on the carriage 21 in a state projecting rearward by a projecting length X/4 relative to the left ultraviolet light irradiation device 23L.

Figure 6A:
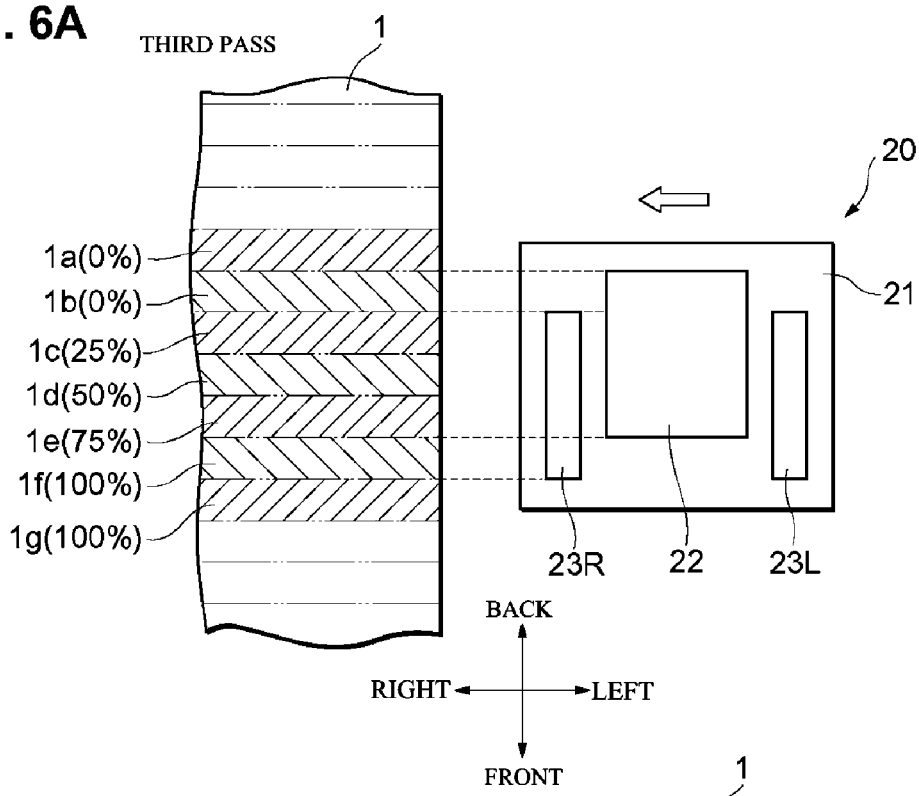
Figure 6B:
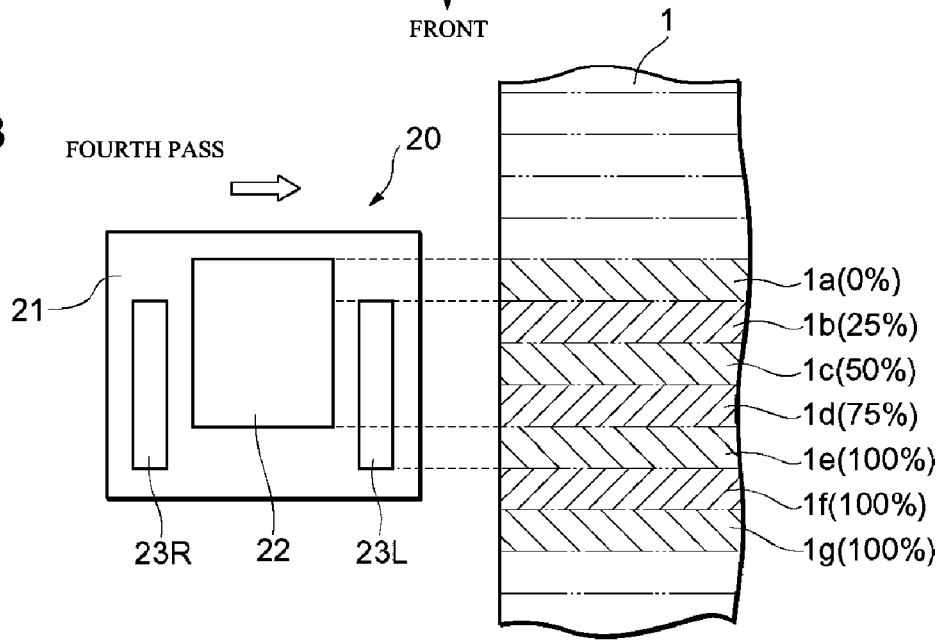

Though the entire structure of the inkjet printer 10 has been described in the above, a printing method in case of printing on the print sheet 1 by the aforementioned print unit 20 will be described with reference to FIGS. 5A, 5B through FIGS. 7A-7E below. FIGS. 6A and 6B are illustrations of the print unit 20 as seen from above and FIGS. 7A-7E are sectional views showing states where UV ink droplets are superposed every pass. It should be noted that the printing method as will be described below is an example of a case that the printing is achieved by four passes.

First, the printing method will be explained roughly. As shown in FIG. 3, UV ink droplets are ejected from the nozzle holes formed in the lower surface of the print head 22 to the print sheet 1 put on the upper surface of the platen 12*a* while the print unit 20 is reciprocated in the right-left direction along the guide rail 15*b* relative to the print sheet 1, thereby depositing the UV ink droplets onto the print sheet 1 in a desired pattern. When the print unit 20 is moved leftward, the right ultraviolet light irradiation device 23R is operated and, on the other hand, when the print unit 20 is moved rightward, the left ultraviolet light irradiation device 23L is operated to irradiate the print sheet 1 with ultraviolet light to cure the UV ink droplets deposited on the print sheet 1.

By the way, if UV ink of 100% of the amount for printing the desired pattern is ejected at once, a large amount of UV ink droplets are deposited in the uncured state on the surface of the print sheet 1 so that the UV ink droplets are mixed with each other and thus bleed because the UV ink droplets are uncured, thus leading to poor print quality. In the inkjet printer 10, therefore, ink of 25% is ejected from the print head 22 while the print unit 20 is reciprocated in the right-left direction. In this manner, the print head 22 passes above the print sheet 1 four times in total so as to apply ink of 100% finally, thereby conducting the printing without bleed of ink as mentioned above. This printing method will be described in detail below.

FIG. 5A shows a state in a middle stage of the printing where the print unit 20 is positioned on the left side of the left end of the print sheet 1. At this point, it is assumed that the printing areas 1*a* through 1*d* in the print sheet 1 are in a non-printed state where no UV ink is deposited, a printing area 1*e* is a state where ink by one pass (25%) is deposited, a printing area if is a state where ink by two passes (50%) is deposited, a printing area 1*g* is a state where ink by three passes (75%) is deposited, and a printing area 1*h* is a state where ink by four passes (100%) is deposited. The width in the front-back direction of each of the printing areas 1*a* through 1*h* corresponds to a projecting length X/4 of the print head 22 projecting rearward relative to the left ultraviolet light irradiation device 23L and corresponds to a feeding amount to be fed by the roller driving motor at one time as will be described later.

From the state shown in FIG. 5A, UV ink for one pass (25%) is ejected from the nozzle holes formed in the lower surface of the print head 22 while the print unit 20 is moved rightward and the left ultraviolet light irradiation device 23L is operated to irradiate the print sheet 1 with ultraviolet light to cure UV ink deposited on the print sheet 1. By moving the print unit 20 to the right end of the print sheet 1, the printing area 1*d* becomes a state where UV ink by one pass (25%) is deposited, the printing area 1*e* becomes a state where UV ink by two passes (50%) is deposited, the printing area if becomes a state where UV ink by three passes (75%) is deposited, and the printing area 1*g* becomes a state where UV ink by four passes (100%) is deposited. Further, the printing areas 1*e* through 1*h* are irradiated with ultraviolet light from the left ultraviolet light irradiation device 23L to cure the deposited UV ink (hereinafter, this will be called "first pass"). In the first pass, no further UV ink is deposited on the printing area 1*h*, but the printing area 1*h* is irradiated with ultraviolet light from the left ultraviolet light irradiation device 23L so as to securely cure the UV ink deposited on or before the last time and fix the UV ink to the print sheet 1.

As described in the above, since the print head 22 is arranged to project rearward by the projecting amount X/4 relative to the left ultraviolet light irradiation device 23L, UV ink by one pass (25%) is deposited on the printing area 1*d*, but the printing area 1*d* is not directly irradiated with ultraviolet light because the left ultraviolet light irradiation device 23L does not pass above the printing area 1*d*. Therefore, UV ink droplets deposited in the beading shape on the surface of the printing area 1*d* enough spread and are thus leveled. By the way, the surface of the printing area 1*d* is irradiated with a slight amount of ultraviolet light leaking from the rear end of the left ultraviolet light irradiation device 23L. By this slight amount of ultraviolet light, the surfaces of the UV ink droplets deposited on the printing area 1*d* are slightly cured, thereby preventing UV ink droplets from bleeding due to mixture. This state is clearly shown in FIGS. 7A-7E in ways easy to understand. UV ink droplets 22*a* deposited in the beading shape on the printing area 1*d* shown in FIG. 7A can enough spread and are leveled during the movement of the print unit 20 to the right end of the print sheet 1, thereby preventing the UV ink droplets 22*a* from being mixed and bleeding like the UV ink droplets 22*b* shown in FIG. 7B.

After the print unit 20 is moved to the right end of the print sheet 1, the roller driving motor is driven to feed the print sheet 1 forward by a distance (the projecting length X/4) corresponding to the width in the front-back direction of each printing area 1*a*-1*h* (see FIG. 5B). When the print sheet 1 is fed forward by the projecting length X/4 strictly, a clearance may be generated relative to a printing by the next pass. To avoid this, it is preferable to feed the print sheet 1 by the projecting length X/4 plus slight extra length.

Figure 7A:
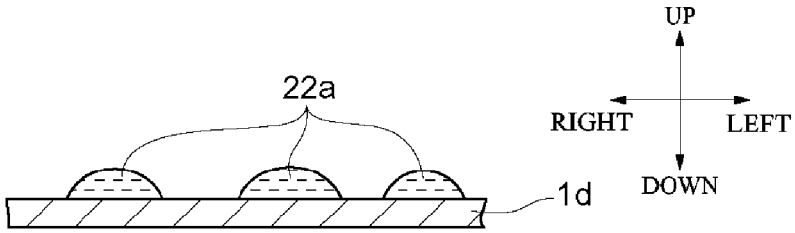
FIGS. 7A-7E are sectional views schematically showing a state where UV ink droplets are superposed from FIG. 7A to FIG. 7E according to the passes.
Figure 7B:
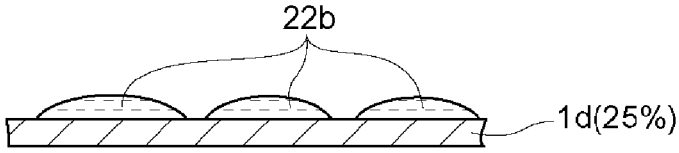
Figure 7C:
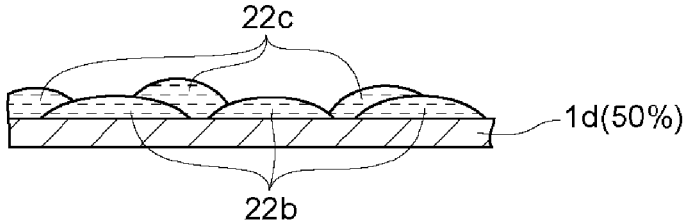

In this state shown in FIG. 5B, UV ink for one pass is ejected from the nozzle holes while the print unit 20 is moved leftward and the right ultraviolet light irradiation device 23R is operated to irradiate the print sheet 1 with ultraviolet light so as cure the UV ink deposited on the print sheet 1. Therefore, by moving the print unit 20 to the left end of the print sheet 1, the printing area 1*c* becomes a state where UV ink by one pass is deposited, the printing area 1*d* becomes a state where UV ink by two passes is deposited, the printing area 1*e* becomes a state where UV ink by three passes is deposited, and the printing area if becomes a state where UV ink by four passes is deposited. During this, in the printing area 1*d*, UV ink droplets 22*c* are deposited or superposed on the UV ink droplets 22*b* which enough spread as shown in FIG. 7C. Since the surfaces of the UV ink droplets 22*b* are slightly cured as mentioned above, deposited UV ink droplets 22*c* do not mixed with the UV ink droplets 22*b* and thus do not bleed and, in addition, spread on the surfaces of the UV ink droplets 22*b* to some degree. Since affinity of the UV ink droplets 22*b* for the UV ink droplets 22*c* is relatively good so that the UV ink droplets 22*b* and the UV ink droplets 22*c* do not reject each other, the adhesion between the UV ink droplets 22*b* and the UV ink droplets 22*c* is improved. Accordingly, the UV ink droplets 22*b* and the UV ink droplets 22*c* are irradiated with ultraviolet light from the right ultraviolet light irradiation device 23R in a state where these ink droplets enough spread and enough adhere to each other (hereinafter, this will be called "second pass").

Figure 7D:
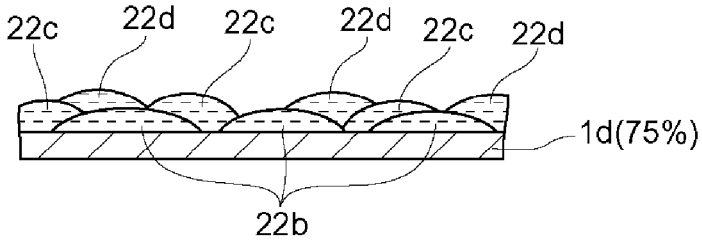

After the print unit 20 is moved to the left end of the print sheet 1 in the manner described above, the roller driving motor is driven to feed the print sheet 1 forward (see FIG. 6A). In the state shown in FIG. 6A, UV ink for one pass is ejected while the print unit 20 is moved rightward and the left ultraviolet light irradiation device 23L is operated. Therefore, by moving the print unit 20 to the right end of the print sheet 1, the printing area 1*b* becomes a state where UV ink by one pass is deposited, the printing area 1*c* becomes a state where UV ink by two passes is deposited, the printing area 1*d* becomes a state where UV ink by three passes is deposited, and the printing area 1*e* becomes a state where UV ink by four passes is deposited. During this, in the printing area 1*d*, UV ink droplets 22*d* are deposited or superposed on the UV ink droplets 22*b* and the UV ink droplets 22*c*, which are cured in the leveled state as shown in FIG. 7D, and are then irradiated with ultraviolet light from the left ultraviolet light irradiation device 23L so that these UV ink droplets are cured (hereinafter, this will be called "third pass").

Figure 7E:
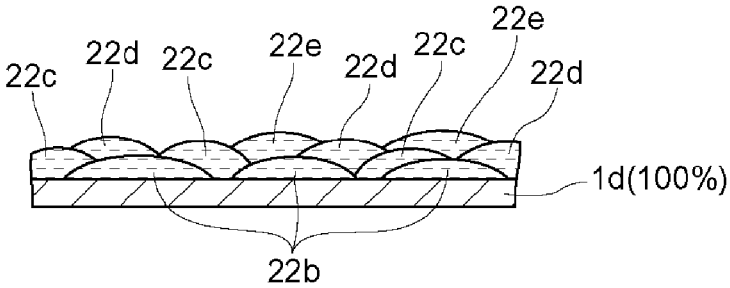

After the print unit 20 is moved to the right end of the print sheet 1, the roller driving motor is driven to feed the print sheet 1 forward (see FIG. 6B). In the state shown in FIG. 6B, UV ink for one pass is ejected while the print unit 20 is moved leftward and the right ultraviolet light irradiation device 23R is operated. Therefore, by moving the print unit 20 to the left end of the print sheet 1, the printing area 1*a* becomes a state where UV ink by one pass is deposited, the printing area 1*b* becomes a state where UV ink by two passes is deposited, the printing area 1*c* becomes a state where UV ink by three passes is deposited, and the printing area 1*d* becomes a state where UV ink by four passes is deposited. During this, in the printing area 1*d*, UV ink droplets 22*e* are deposited or superposed on the UV ink droplets 22*b*, 22*c*, and 22*d*, which are cured as shown in FIG. 7E, and are then irradiated with ultraviolet light from the right ultraviolet light irradiation device 23R so that these UV ink droplets are cured (hereinafter, this will be called "fourth pass"). It should be understood that the UV ink droplets 22*b*, 22*c*, 22*d*, and 22*e* are completely cured and fixed to the print sheet 1 by irradiation of ultraviolet light from the left ultraviolet light irradiation device 23L at the next pass, thus completing the printing relative to the printing area 1*d*.

Though the description has been made with reference to the printing process relative to the printing area 1*d*, the same process is conducted for printing on all printing areas of the print sheet 1. That is, in the first pass, UV ink of 25% is deposited and the ultraviolet light irradiation device does not pass above the deposited UV ink. Therefore, in this first pass, the aforementioned UV ink droplets are rarely cured so that the LTV ink droplets enough spread and are thus leveled on the surface of the print sheet. Since UV ink droplets ejected at the second through fourth passes are sequentially deposited and superposed on each other in the state that the UV ink droplets are enough leveled as mentioned above, the UV ink droplets can be cured in a state where these are leveled as a whole as compared to a case that UV ink droplets are sequentially superposed on UV ink droplets which are cured in the state remaining the beading shape. Accordingly, this is a simple structure that the print head 22 is arranged to shift rearward relative to the right ultraviolet light irradiation device 23R (the left ultraviolet light irradiation device 23L), but enables high-quality printing having visual appearance as good as a desired printed matter.

Second Embodiment

Figure 8A:
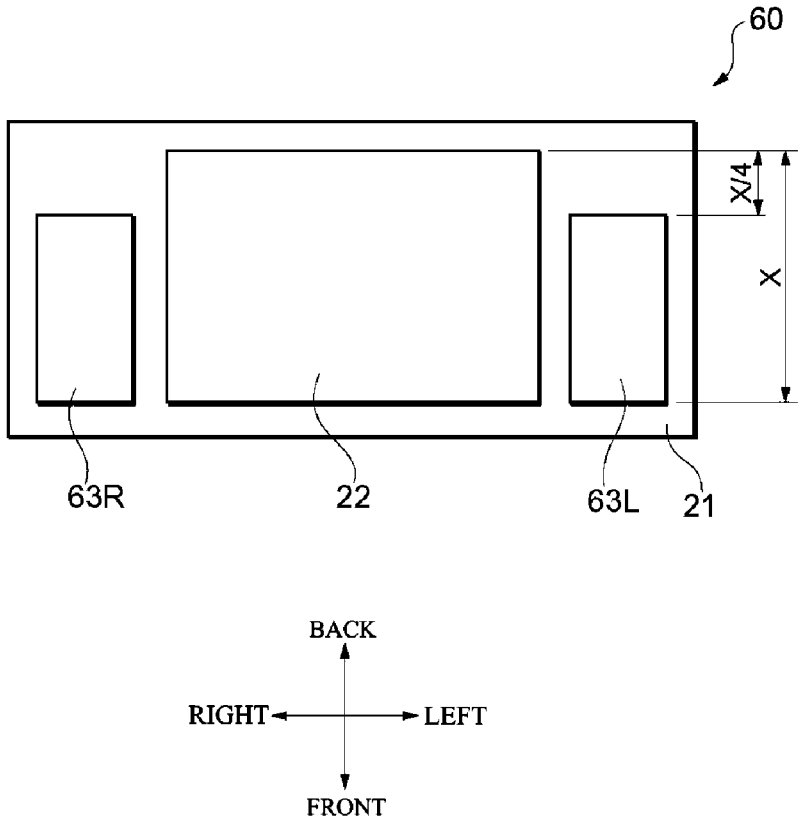
FIG. 8A is a plan view showing a print unit according to a second embodiment and FIG. 8B is a plan view showing a print unit according to a third embodiment.

With reference to FIG. 8A, the second embodiment as one of embodiments of the present invention will be described. FIG. 8A shows an illustration of a print unit as seen from above. Since the structure of the second embodiment is the same as the aforementioned first embodiment, except the print unit, description about the same components as those of the first embodiment will be omitted by using the same numerals. The same is true for the third through fifth embodiments as will be described later. Hereinafter, a print unit 60 having different structure from that of the first embodiment 1 will be described.

The print unit 60 is mainly composed of a carriage 21, a print head 22, and a left ultraviolet light irradiation device 63L, and a right ultraviolet light irradiation device 63R. Since the left ultraviolet light irradiation device 63L and the right ultraviolet light irradiation device 63R have the same structure, description will be made as regard to the left ultraviolet light irradiation device 63L. In the state where the left ultraviolet light irradiation device 63L is mounted on the carriage 21, the front end position of the left ultraviolet light irradiation device 63L is substantially equal to the front end position of the print head 22 and the print head 22 projects rearward relative to the left ultraviolet light irradiation device 63L by a projecting length X/4. According to the structure, the same effect as the first embodiment can be obtained and, in addition, the width in the front-back direction of the left ultraviolet light irradiation device 63L and the right ultraviolet light irradiation device 63R can be reduced, thereby achieving the print unit 60 which is compact in the front-back direction.

Third Embodiment

Figure 8B:
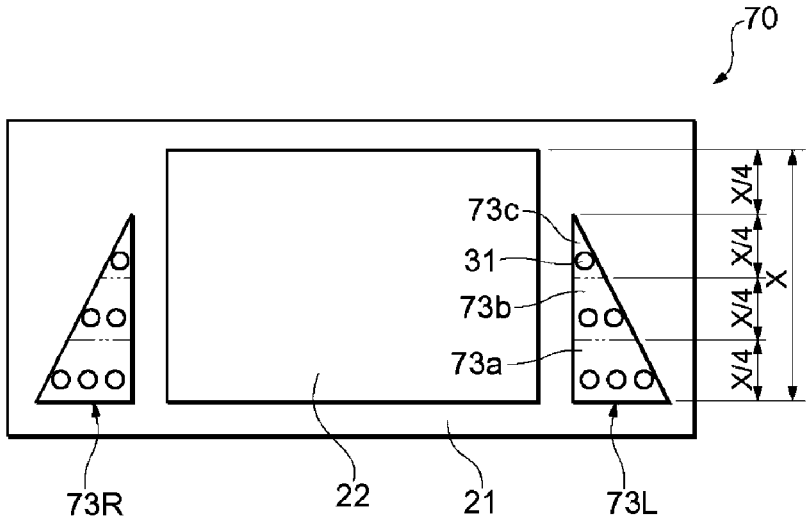

With reference to FIG. 8B, the third embodiment as one of embodiments of the present invention will be described. Hereinafter, a print unit 70 having different structure from that of the first embodiment 1 will be mainly described.

The print unit 70 is mainly composed of a carriage 21, a print head 22, and a left ultraviolet light irradiation device 73L, and a right ultraviolet light irradiation device 73R. Description will be made as regard to the left ultraviolet light irradiation device 73L. In the state where the left ultraviolet light irradiation device 73L is mounted on the carriage 21, the front end position of the left ultraviolet light irradiation device 73L is substantially equal to the front end position of the print head 22 and the print head 22 projects rearward relative to the left ultraviolet light irradiation device 73L by a projecting length X/4. The left ultraviolet light irradiation device 73L has such a structure that the number of UVLED modules 31 arranged is increased toward the front end. For example, three UVLED modules 31 are arranged in a front area 73*a* at the front end side, two UVLED modules 31 are arranged in a middle area following the front area 73*a*, and one UVLED module 31 is arranged in a rear area following the middle area 73*b*. It should be noted that the front area 73*a*, the middle area 73*b*, and the rear area 73*c* each have the width X/4 in the front-back direction.

According to the structure, ultraviolet light of intensity proportional to the number of UVLED modules 31 arranged is radiated by operating the respective UVLED modules 31 during the printing. For example, ultraviolet light of high intensity is radiated from the front area 73*a*, ultraviolet light of low intensity is radiated from the rear area 73*c*, and ultraviolet light of medium intensity is irradiated from the middle area 73*b*. Therefore, irradiation of ultraviolet light is not conducted on the first pass, and UV ink droplets are irradiated with ultraviolet light of intensity increased as it goes from the second pass to the fourth pass and are thus cured. For example, UV ink droplets deposited in the first through third passes are irradiated with ultraviolet light of which intensity is low, i.e. not enough for completely curing the UV ink droplets, so as to prevent the UV ink droplet from bleeding and to level the UV ink droplets sufficiently. Then, in the fourth pass, ultraviolet light of which intensity is enough for complete curing is radiated, thereby achieving printing capable of completely curing all UV ink droplets deposited in the first through fourth passes. In this manner, the UV ink droplets are cured in a state that these are leveled as a whole, thereby achieving high-quality printing having visual appearance as good as a desired printed matter.

Fourth Embodiment

Figure 9A:
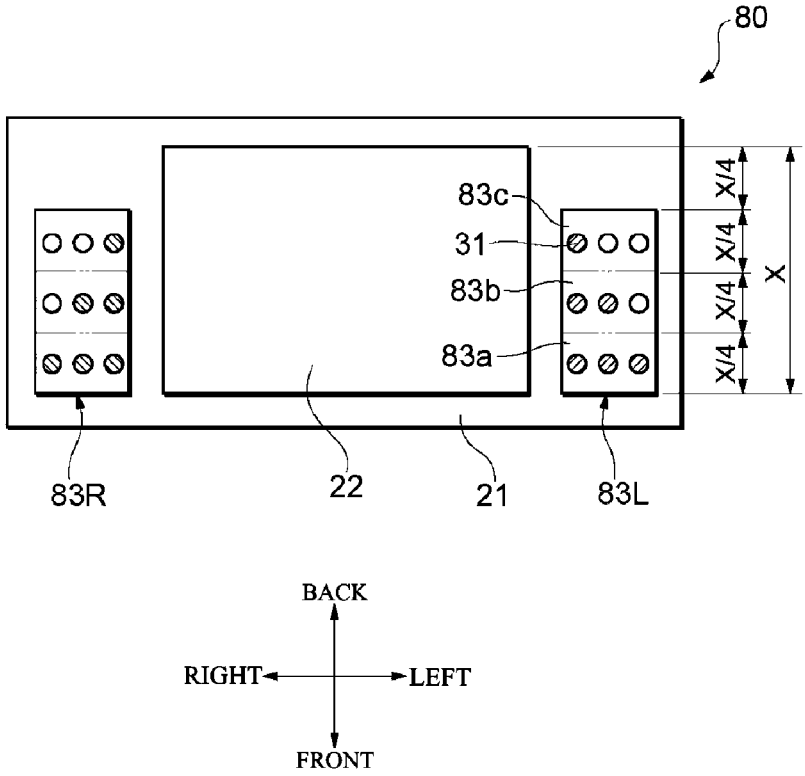
FIG. 9A is a plan view showing a print unit according to a fourth embodiment and FIG. 9B is a plan view showing a print unit according to a fifth embodiment.

With reference to FIG. 9A, the fourth embodiment as one of embodiments of the present invention will be described. Hereinafter, a print unit 80 having different structure from that of the first embodiment 1 will be mainly described.

The print unit 80 is mainly composed of a carriage 21, a print head 22, and a left ultraviolet light irradiation device 83L, and a right ultraviolet light irradiation device 83R. Description will be made as regard to the left ultraviolet light irradiation device 83L. In the state where the left ultraviolet light irradiation device 83L is mounted on the carriage 21, the front end position of the left ultraviolet light irradiation device 83L is substantially equal to the front end position of the print head 22 and the print head 22 projects rearward relative to the left ultraviolet light irradiation device 83L by a projecting distance X/4. In the left ultraviolet light irradiation device 83L, three UVLED modules 31 are aligned in the right-left direction in each of a front area 83*a*, a middle area 83*b*, and a rear area 83*c* of which width in the front-back direction is X/4.

During the printing, the UVLED modules 31 are controlled by a controller 13*b* in such a manner that three of the UVLED modules 31 in the front area 83*a*, two of the UVLED modules 31 in the middle area 83*b*, and one of the UVLED modules 31 in the rear area 83*c*. For ease of understanding, the UVLED modules 31 which are controlled to be operated are hatched in FIG. 9A. By controlling the operation in this manner, similarly to the aforementioned third embodiment, ultraviolet light of high intensity is radiated from the front area 83*a*, ultraviolet light of low intensity is radiated from the rear area 83*c*, and ultraviolet light of medium intensity is irradiated from the middle area 83*b*, thereby obtaining the same effects as the third embodiment.

Fifth Embodiment

Figure 9B:
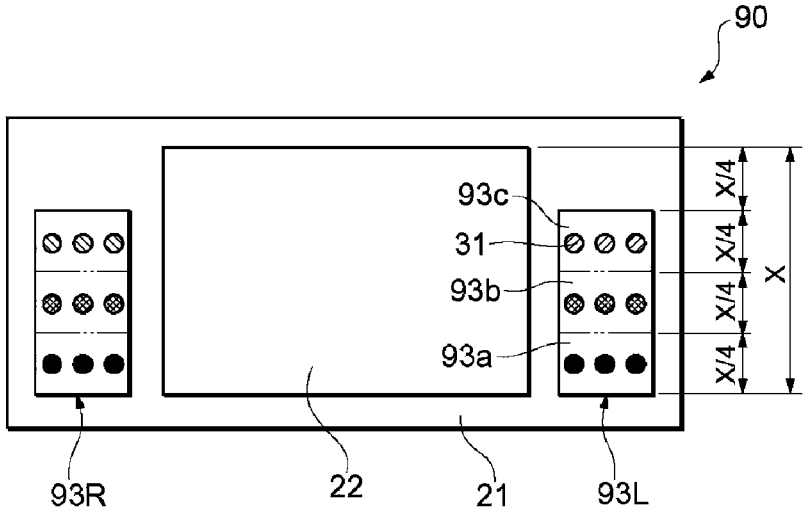
Figure 10A:
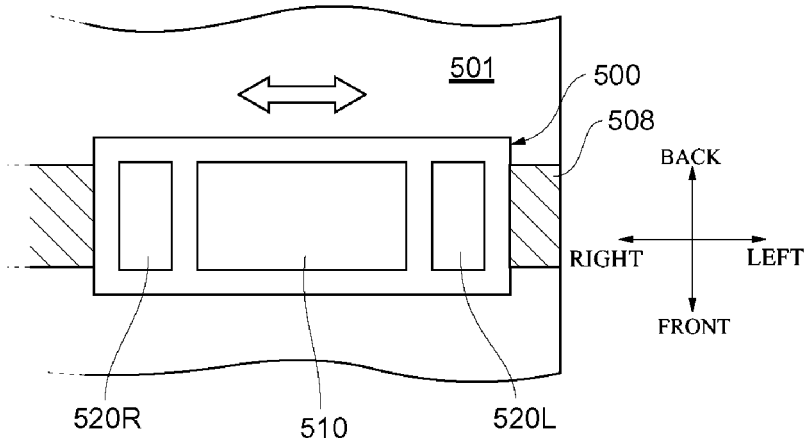
FIG. 10A is a plan view showing a conventional print unit.
Figure 10B:
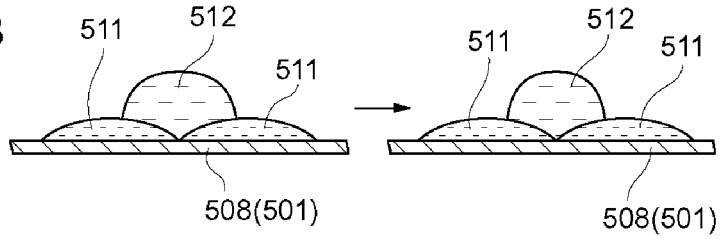
BACKGROUND ART FIG. 10B
FIG. 10B is a sectional view showing a state that UV ink droplets are deposited on completely cured UV ink droplets.
Figure 10C:
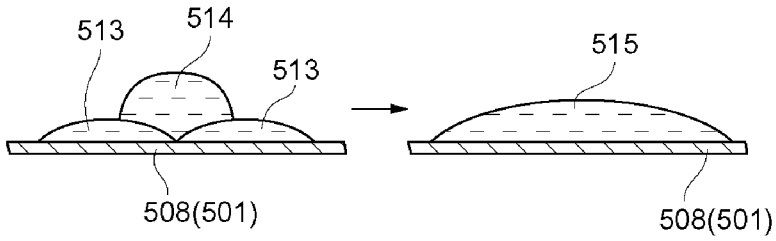
BACKGROUND ART FIG. 10C
FIG. 10C is a sectional view showing a state that UV ink droplets are deposited on uncured UV ink droplets.

With reference to FIG. 9B, the fifth embodiment as one of embodiments of the present invention will be described.

Hereinafter, a print unit 90 having a structure different from that of the first embodiment 1 will be mainly described.

The print unit 90 is mainly composed of a carriage 21, a print head 22, and a left ultraviolet light irradiation device 93L, and a right ultraviolet light irradiation device 93R. Description will be made as regard to the left ultraviolet light irradiation device 93L. In the state where the left ultraviolet light irradiation device 93L is mounted on the carriage 21, the front end position of the left ultraviolet light irradiation device 93L is substantially equal to the front end position of the print head 22 and the print head 22 projects rearward relative to the left ultraviolet light irradiation device 83L by a projecting length X/4. In the left ultraviolet light irradiation device 93L, three UVLED modules 31 are aligned in the right-left direction in each of a front area 93*a*, a middle area 93*b*, and a rear area 93*c* of which width in the front-back direction is X/4.

During the printing, the intensities of ultraviolet lights emitted from the UVLED modules 31 are controlled by a controller 13*b*. Concretely, the intensity control is conducted such that, for example, the three UVLED modules 31 in the front area 93*a* radiate ultraviolet light of high intensity, the three UVLED modules 31 in the middle area 93*b* radiate ultraviolet light of medium intensity, and the three UVLED modules 31 in the rear area 93*c* radiate ultraviolet light of low intensity. By this intensity control, as a whole, ultraviolet light of high intensity is radiated from the front area 93*a*, ultraviolet light of medium intensity is irradiated from the middle area 93*b*, and ultraviolet light of low intensity is radiated from the rear area 93*c*, thereby obtaining the same effects as the third embodiment.

Among the aforementioned embodiments, a combination of the third embodiment and the fifth embodiment may be employed. As shown in FIG. 8B, three UVLED modules 31 are arranged in the front area 73*a*, two UVLED modules 31 are arranged in the middle area 73*b*, and one UVLED module 31 is arranged in the rear area 73*c*. In this arrangement, the intensities of ultraviolet light radiated from the respective UVLED modules 31 are controlled by the controller 13*b*. The UVLED modules 31 are controlled such that, for example, the ultraviolet light from the front area 73*a* has high intensity, the ultraviolet light from the middle area 73*b* has medium intensity, and the ultraviolet light from the rear area 73*c* has low intensity. In this manner, the intensity of ultraviolet light radiated from the rear area 73*c* can be set lower than that of the third embodiment and the intensity of ultraviolet light radiated from the front area 73*a* can be set higher than that of the third embodiment. By the way, certain kinds of UV inks require ultraviolet light of relatively high intensity to completely cure. This arrangement effects in case of using such kind of UV ink.

Though the four-pass printing method by depositing UV ink in four batches has been described in the aforementioned embodiment, the present invention is not limited to this printing method. For example, in case of printing by eight passes, the projecting length is set to X/8 and the amount of the print sheet 1 to be fed at once by the roller driving motor is set X/8, thereby enabling the printing to which the present invention is applied.

Though the arrangement in which the print sheet 1 is fed forward every time UV ink for one pass (25%) is ejected from the print head 22 and the print unit 20 is moved to the left end or the right end of the print sheet has been described in any of the aforementioned embodiments, the present invention is not limited to this arrangement. For example, from the state shown in FIG. 5A, the print unit 20 is moved to the right end of the print sheet 1 while UV ink of a half of one pass (12.5%) is ejected from the print head 22 and, after that, the print unit 20 is moved to the left end of the print sheet 1 without moving the print sheet 1 forward so that the print sheet 1 remains at the same position in the front-back direction. As a result of this, UV ink for one pass (25%) is deposited on the printing area 1*d*. After that, from the state as shown in FIG. 5A where the print unit 20 is positioned on the left end of the print sheet 1, the print sheet 1 is fed forward and the print unit 20 is reciprocated in the right-left direction while ejecting UV ink of 12.5% from the print head 22 again. By repeatedly conducting this action, printing on the entire print sheet 1 is conducted. In case of printing in this manner, the amount of UV ink deposited on the print sheet 1 at one time can be reduced, thereby reducing the bleed between deposited UV ink droplets.

Though an arrangement in which the present invention is applied to an inkjet printer of a type of printing by reciprocating a print unit in the right-left direction and feeding a print sheet 1 forward has been described in the aforementioned embodiment, the present invention is not limited to this arrangement. For example, the present invention may be applied to an inkjet printer of so-called flat bed type in which printing is conducted by reciprocating a print unit in the right-left direction and moving the print unit in the front-rear direction in a state a print medium is put on and fixed to a tabular bed.

Though an arrangement in which the front end position of the ultraviolet light irradiation device and the front end position of the print head 22 are substantially the same has been described in the aforementioned second through fifth embodiments, the present invention is not limited this arrangement. For example, similarly to the first embodiment, an arrangement in which the left ultraviolet light irradiation device (the right ultraviolet light irradiation device) projects forward relative to the print head 22 may be employed.

In the aforementioned inkjet printer of the embodiments of the present invention, it is preferable that the print head is designed to eject a predetermined amount of ink to the print medium every time the print head is moved in the first direction by the carriage in a predetermined plural number of times, the predetermined amount corresponding to the predetermined plural number, and that, assuming that the width in the second direction of the print head is X and the predetermined plural number is A, the predetermined length is set to be larger than X/A.

Further, in the aforementioned inkjet printer of the embodiments of the present invention, it is preferable that the carriage is designed to move relative to the print medium from one end to the other end in the first direction and then return from the other end to the one end and, at the one end, to be moved relative to the print medium in the second direction.

In the aforementioned inkjet printer of the embodiments of the present invention, the carriage may be designed to move relative to the print medium in the first direction from the one end to the other end and, at the other end, to be moved relative to the print medium in the second direction, and to move relative to the print medium in the first direction from the other end to the one end.

Further, in the aforementioned inkjet printer of the embodiments of the present invention, it is preferable that the ultraviolet light irradiation device is composed of a plurality of LEDs (for example, the UVLED modules 31 in the following embodiments) emitting ultraviolet light which are aligned in the second direction, such that the number of LEDs arranged at the downstream of the feeding direction in the second direction is larger than the number of LEDs arranged at the upstream of the feeding direction.

Furthermore, in the aforementioned inkjet printer of the embodiments of the present invention, it is preferable that the intensity of ultraviolet light emitted from each of the LEDs is controllable, that the inkjet printer includes an intensity controller (for example, the controller 13*b* in the following embodiments) for controlling the intensity of ultraviolet light emitted from each of the LEDs, and that the intensity controller conducts the light intensity control such that the intensity of the LED arranged at the downstream of the feeding direction in the second direction is higher than the intensity of the LED arranged at the upstream of the feeding direction.

In the inkjet printer according to the embodiments of the present invention, the print head is mounted on the carriage in such a manner as to project toward the upstream of the feeding direction relative to the ultraviolet light irradiation device by the predetermined length. According to this arrangement, ink droplets which are ejected from a portion of the print head projecting toward the upstream of the feeding direction by the predetermined length during the movement of the carriage in the reciprocating direction perpendicular to the feeding direction are not directly irradiated with ultraviolet light because the ultraviolet light irradiation device does not pass above the ink droplets immediately after the ink droplets are deposited on the print medium. Accordingly, this is a simple structure that the print head and the ultraviolet light irradiation device on the carriage are arranged in the adjusted positions, but prevents the ink droplets in the beading shape deposited on the print medium from being cured in the beading shape immediately after the ink droplets are deposited and allows the ink droplets to enough spread and thus leveled on the surface of the print medium. Moreover, the ink droplets deposited on the print medium are indirectly irradiated with a slight amount of ultraviolet light from the ultraviolet light irradiation device so that only the surfaces of the UV ink droplets deposited are cured, thereby preventing the UV ink droplets from bleeding due to mixture.

It is preferable that the print head is designed to eject ink every time the print head is moved in the reciprocating direction by the carriage in a predetermined plural number of times, and that, assuming that the width in the feeding direction of the print head is X and the predetermined plural number is A, the predetermined length is set to be larger than X/A. In case that ink is ejected in four batches, the predetermined length is set to be larger than X/4 so that, when ink droplets are ejected onto a printing area where no ink has been deposited during printing, the ink droplets are prevented from being irradiated directly with ultraviolet light immediately after the ink droplets are ejected and deposited on this printing area. Therefore, the ink droplets in the beading shape are prevented from being cured in the beading shape immediately after the ink droplets are deposited and are allowed to enough spread and thus leveled on the surface of the print medium.

It is preferable that the carriage is designed to move relative to the print medium from one end to the other end in the first direction and then return from the other end to the one end and, at the one end, to be moved relative to the print medium in the second direction. According to this arrangement, the print head is moved to deposit ink droplets not to create gaps relative to the print medium, thereby enabling high-quality printing.

Alternatively, the carriage may be designed to be moved relative to the print medium in the second direction every time the carriage moves the one end or the other end. According to this arrangement, the print head can be moved relative to the print medium rapidly, thereby shortening the printing time.

Further, it is preferable that the LEDs composing the ultraviolet light irradiation device are arranged such that the number of LEDs arranged at the downstream of the feeding direction is larger than the number of LEDs arranged at the upstream of the feeding direction. According to this arrangement, the intensity of ultraviolet light irradiated from the downstream of the feeding direction of the ultraviolet light irradiation device can be set to be high. Therefore, the portion of the print medium on which ink droplets are deposited by all of the predetermined plural number of times can be irradiated with high-intensity ultraviolet light, thereby completely curing the ink droplets and thus securely fixing the ink droplets to the print medium.

Furthermore, it is preferable that the ultraviolet light intensity is controlled by the intensity controller such that the intensity of the LED arranged at the downstream of the feeding direction is higher than the intensity of the LED arranged at the upstream of the feeding direction. According to this arrangement, since the upstream of the feeding direction irradiates relatively low-intensity ultraviolet light, the ink droplets are prevented from being completely cured and are allowed to enough spread and thus be leveled. In addition, since the downstream of the feeding direction irradiates high-intensity ultraviolet light, the ink droplets are completely cured and securely fixed to the print medium.

The printing method of the embodiment of the present invention includes: a first step of ejecting ink droplets toward the print medium from a portion of the print head projecting toward the upstream side of the feeding direction relative to the ultraviolet light irradiation device; and a second step of ejecting ink droplets from a portion of the print head, on a side in the first direction of which the ultraviolet light irradiation device is positioned, such that the ink droplets thus ejected are superposed on the ink droplets deposited in the first step, and irradiating the ink droplets with ultraviolet light from the ultraviolet light irradiation device so as to cure the ink droplets. Accordingly, the ink droplets deposited in the breading shape on the print medium are prevented from being cured in the breading state immediately after the ink droplets are deposited and are allowed to enough spread and thus be leveled on the surface of the print medium. In addition, the ink droplets ejected in the second step are superposed on the ink droplets thus leveled and are cured, whereby the ink droplets can be cured in a state where these are leveled as a whole. Therefore, this arrangement enables high-quality printing not so different from a desired printed matter.

Obviously, numerous modifications and variations of the present invention are possible in light of the above teachings. It is therefore to be understood that within the scope of the appended claims, the invention may be practiced otherwise than as specifically described herein.

What is claimed is:

1. An inkjet printer comprising:

a medium supporter to support a print medium;

a print head configured to eject ink droplets toward the print medium supported by said medium supporter;

an ultraviolet light irradiation device configured to irradiate the print medium with ultraviolet light to cure ink deposited on said print medium; and a carriage on which said print head and said ultraviolet light irradiation device are mounted to face said medium supporter and which is reciprocally movable relative to the print medium in a first direction and which is movable relative to the print medium in a second direction perpendicular to the first direction, said ultraviolet light irradiation device being arranged on a side in the first direction of said print head, said print head being arranged to project toward an upstream side of a feeding direction in the second direction by a predetermined length relative to said ultraviolet light irradiation device, wherein said print head is configured to eject a predetermined amount of ink to the print medium every time said print head is moved in the first direction by said carriage in a predetermined plural number of times, the predetermined amount corresponding to the predetermined plural number; and wherein the predetermined length is set to be larger than X/A, wherein X is a width of said print head in the second direction and A is the predetermined plural number.

2. The inkjet printer according to claim 1, wherein said carriage is movable relative to the print medium from one end to another end and from the another end to the one end in the first direction; and wherein said carriage is movable relative to the print medium in the second direction when said carriage is positioned at the one end.

3. The inkjet printer according to claim 1, wherein said ultraviolet light irradiation device comprises a plurality of LEDs aligned in the second direction to emit ultraviolet light, a larger number of said LEDs being arranged at a downstream side of the feeding direction in the second direction than at the upstream side of the feeding direction.

4. The inkjet printer according to claim 3, further comprising an intensity controller configured to control an intensity of ultraviolet light emitted from each of said LEDs, said intensity controller being configured to conduct light intensity control such that an intensity of downstream LEDs arranged at the downstream side of the feeding direction in the second direction is higher than an intensity of upstream LEDs arranged at the upstream side of the feeding direction.

5. An inkjet printer comprising:

a medium supporter to support a print medium;

a print head configured to eject ink droplets toward the print medium supported by said medium supporter;

an ultraviolet light irradiation device configured to irradiate the print medium with ultraviolet light to cure ink deposited on said print medium; and a carriage on which said print head and said ultraviolet light irradiation device are mounted to face said medium supporter and which is reciprocally movable relative to the print medium in a first direction and which is movable relative to the print medium in a second direction perpendicular to the first direction, said ultraviolet light irradiation device being arranged on a side in the first direction of said print head, said print head being arranged to project toward an upstream side of a feeding direction in the second direction by a predetermined length relative to said ultraviolet light irradiation device, wherein said ultraviolet light irradiation device comprises a plurality of LEDs aligned in the second direction to emit ultraviolet light, a larger number of said LEDs being arranged at a downstream side of the feeding direction in the second direction than at the upstream side of the feeding direction.

6. The inkjet printer according to claim 5, further comprising an intensity controller configured to control an intensity of ultraviolet light emitted from each of said LEDs, said intensity controller being configured to conduct light intensity control such that an intensity of downstream LEDs arranged at the downstream side of the feeding direction in the second direction is higher than an intensity of upstream LEDs arranged at the upstream side of the feeding direction.

7. A printing method comprising:

providing an inkjet printer comprising:

a medium supporter to support a print medium;

a print head configured to eject ink droplets toward the print medium supported by said medium supporter;

an ultraviolet light irradiation device configured to irradiate the print medium with ultraviolet light to cure ink deposited on said print medium; and a carriage on which said print head and said ultraviolet light irradiation device are mounted to face said medium supporter and which is reciprocally movable relative to the print medium in a first direction and which is movable relative to the print medium in a second direction perpendicular to the first direction, said ultraviolet light irradiation device being arranged on a side in the first direction of said print head, said print head being arranged to project toward an upstream side of a feeding direction in the second direction by a predetermined length relative to said ultraviolet light irradiation device;

ejecting a first ink droplet toward the print medium from a portion of the print head projecting toward the upstream side of the feeding direction in the second direction relative to the ultraviolet light irradiation device, while moving the carriage relative to the print medium in the first direction;

moving the carriage relative to the print medium in the second direction to, while moving said carriage in the first direction, eject a second ink droplet from a portion of the print head on a side in the first direction where the ultraviolet light irradiation device is positioned such that the second ink droplet is superposed on the first ink droplet; and irradiating the first and second ink droplets with ultraviolet light from the ultraviolet light irradiation device to cure the first and second ink droplets.

8. An inkjet printer comprising:

a medium supporter to support a print medium;

a print head configured to eject ink droplets toward the print medium supported by said medium supporter;

at least one ultraviolet light irradiation device configured to irradiate the print medium with ultraviolet light to cure ink deposited on said print medium; and a carriage on which said print head and said at least one ultraviolet light irradiation device are mounted to face said medium supporter and which is reciprocally movable relative to the print medium in a first direction and which is movable relative to the print medium in a second direction perpendicular to the first direction, said at least one ultraviolet light irradiation device being arranged on one or more sides in the first direction of said print head, said print head being arranged to project toward an upstream side of a feeding direction in the second direction by a predetermined length relative to an ultraviolet light irradiation device of said at least one ultraviolet light irradiation device that is provided at a furthest upstream location on said carriage, wherein said carriage is movable relative to the print medium from one end to another end and from the another end to the one end in the first direction, wherein said carriage is movable relative to the print medium in the second direction when said carriage is positioned at the one end, and wherein said at least one ultraviolet light irradiation device comprises a plurality of LEDs aligned in the second direction to emit ultraviolet light, a larger number of said LEDs being arranged at a downstream side of the feeding direction in the second direction than at the upstream side of the feeding direction.

9. The inkjet printer according to claim 8, further comprising an intensity controller configured to control an intensity of ultraviolet light emitted from each of said LEDs, said intensity controller being configured to conduct light intensity control such that an intensity of downstream LEDs arranged at the downstream side of the feeding direction in the second direction is higher than an intensity of upstream LEDs arranged at the upstream side of the feeding direction.

10. An inkjet printer comprising:

a medium supporter to support a print medium;

a print head configured to eject ink droplets toward the print medium supported by said medium supporter;

at least one ultraviolet light irradiation device configured to irradiate the print medium with ultraviolet light to cure ink deposited on said print medium; and a carriage on which said print head and said at least one ultraviolet light irradiation device are mounted to face said medium supporter and which is reciprocally movable relative to the print medium in a first direction and which is movable relative to the print medium in a second direction perpendicular to the first direction, said at least one ultraviolet light irradiation device being arranged on one or more sides in the first direction of said print head, said print head being arranged to project toward an upstream side of a feeding direction in the second direction by a predetermined length relative to an ultraviolet light irradiation device of said at least one ultraviolet light irradiation device that is provided at a furthest upstream location on said carriage, wherein said carriage is movable relative to the print medium from one end to another end and from the another end to the one end in the first direction, wherein said carriage is movable relative to the print medium in the second direction when said carriage is positioned at the one end, wherein said carriage is firstly moved relatively to the print medium from the one end to the another end in the first direction, secondly moved relatively to said print medium in the second direction when said carriage is positioned at the another end, and thirdly moved relatively to the print medium in the first direction from the another end to the one end, and wherein said at least one ultraviolet light irradiation device comprises a plurality of LEDs aligned in the second direction to emit ultraviolet light, a larger number of said LEDs being arranged at a downstream side of the feeding direction in the second direction than at the upstream side of the feeding direction.

11. The inkjet printer according to claim 10, further comprising an intensity controller configured to control an intensity of ultraviolet light emitted from each of said LEDs, said intensity controller being configured to conduct light intensity control such that an intensity of downstream LEDs arranged at the downstream side of the feeding direction in the second direction is higher than an intensity of upstream LEDs arranged at the upstream side of the feeding direction.

12. An inkjet printer comprising:

medium supporting means for supporting a print medium;

print head means for ejecting ink droplets toward the print medium supported by said medium supporting means;

ultraviolet light irradiation means for irradiating the print medium with ultraviolet light to cure ink deposited on said print medium; and carriage means for mounting said print head means and said ultraviolet light irradiation means on said carriage means to face said medium supporting means, said carriage means being reciprocally movable relative to the print medium in a first direction and movable relative to the print medium in a second direction perpendicular to the first direction, said ultraviolet light irradiation means being arranged on a side in the first direction of said print head means, said print head means being arranged to project toward an upstream side of a feeding direction in the second direction by a predetermined length relative to said ultraviolet light irradiation means, wherein said print head means ejects a predetermined amount of ink to the print medium every time said print head means is moved in the first direction by said carriage means in a predetermined plural number of times, the predetermined amount corresponding to said predetermined plural number; and wherein said predetermined length is set to be larger than X/A, wherein X is a width of said print head in the second direction and A is the predetermined plural number.

13. An inkjet printer comprising:

medium supporting means for supporting a print medium;

print head means for ejecting ink droplets toward the print medium supported by said medium supporting means;

ultraviolet light irradiation means for irradiating the print medium with ultraviolet light to cure ink deposited on said print medium; and carriage means for mounting said print head means and said ultraviolet light irradiation means on said carriage means to face said medium supporting means, said carriage means being reciprocally movable relative to the print medium in a first direction and movable relative to the print medium in a second direction perpendicular to the first direction, said ultraviolet light irradiation means being arranged on a side in the first direction of said print head means, said print head means being arranged to project toward an upstream side of a feeding direction in the second direction by a predetermined length relative to said ultraviolet light irradiation means, wherein said ultraviolet light irradiation means comprises a plurality of LEDs aligned in the second direction to emit ultraviolet light, a larger number of said LEDs being arranged at a downstream side of the feeding direction in the second direction than at the upstream side of the feeding direction.

14. The inkjet printer according to claim 13, further comprising intensity controlling means for controlling an intensity of ultraviolet light emitted from each of said LEDs, said intensity controlling means conducting light intensity control such that an intensity of downstream LEDs arranged at the downstream side of the feeding direction in the second direction is higher than an intensity of upstream LEDs arranged at the upstream side of the feeding direction.

* * * * *